US010597897B2

(12) United States Patent
Yang et al.

(10) Patent No.: US 10,597,897 B2
(45) Date of Patent: Mar. 24, 2020

(54) COLLAPSIBLE CANOPY WITH A SELF LOCKING CENTRAL LOCK

(71) Applicants: Shengyong Yang, Shanghai (CN); Jing Bian, Shanghai (CN)

(72) Inventors: Shengyong Yang, Shanghai (CN); Jing Bian, Shanghai (CN)

( * ) Notice: Subject to any disclaimer, the term of this patent is extended or adjusted under 35 U.S.C. 154(b) by 0 days.

(21) Appl. No.: 16/012,076

(22) Filed: Jun. 19, 2018

(65) Prior Publication Data

US 2018/0298631 A1 Oct. 18, 2018

Related U.S. Application Data

(63) Continuation-in-part of application No. 15/925,314, filed on Mar. 19, 2018, which is a continuation-in-part of application No. 15/549,164, filed as application No. PCT/CN2016/091675 on Jul. 26, 2016, now Pat. No. 10,273,710.

(51) Int. Cl.

| | |
|---|---|
| ***E04H 15/46*** | (2006.01) |
| ***E04H 15/48*** | (2006.01) |
| ***E04H 15/50*** | (2006.01) |

(52) U.S. Cl.

CPC ..... *E04H 15/46* (2013.01); *E04H 15/48* (2013.01); *E04H 15/50* (2013.01)

(58) Field of Classification Search

CPC ..... E04H 15/46; E04H 15/48; E04H 15/50

USPC ..... 135/135, 146, 147, 159

See application file for complete search history.

(56) References Cited

U.S. PATENT DOCUMENTS

| | | | | |
|---|---|---|---|---|
| 1,666,757 A * | 4/1928 | Snyder | E04H 15/28 | 135/116 |
| 1,728,356 A * | 9/1929 | Morgan | E04H 15/50 | 135/154 |
| 4,945,936 A * | 8/1990 | Surrendi | E04H 15/322 | 135/126 |
| 6,199,572 B1 * | 3/2001 | Rousselle | E04H 15/28 | 135/126 |
| 6,336,465 B1 * | 1/2002 | Surrendi | E04H 15/28 | 135/121 |
| 6,854,476 B1 * | 2/2005 | Chai | E04H 15/48 | 135/135 |
| 7,628,165 B2 * | 12/2009 | Rothweil | E04H 15/48 | 135/135 |

(Continued)

FOREIGN PATENT DOCUMENTS

KR 20020043204 A * 6/2002

OTHER PUBLICATIONS

Derwent-ACC-No. 2018-32464C, Abstract of CN 207260738 U, Apr. 20, 2018. (Year: 2018).*

*Primary Examiner* — Robert Canfield

(74) *Attorney, Agent, or Firm* — John R. Ross, III; John R. Ross

(57) ABSTRACT

A collapsible canopy with an improved locking mechanism. The collapsible canopy has at least three supporting legs. The collapsible canopy also has a self-locking central lock that is used for locking the collapsible canopy in an unfolded state and permits the collapsible canopy to be folded into a folded state when the central lock is unlocked. An outer retractable unit is connected between each adjacent supporting leg. An inner retractable unit having an inner end is connected between each supporting leg and the central lock. The inner end of the inner retractable unit is connected through the central lock.

5 Claims, 15 Drawing Sheets

(56) References Cited

U.S. PATENT DOCUMENTS

| | | | | |
|---|---|---|---|---|
| 8,469,045 | B2 * | 6/2013 | Zhou | E04H 15/28 135/135 |
| 9,995,057 | B2 * | 6/2018 | Wu | E04H 15/46 |
| 2003/0183266 | A1 * | 10/2003 | Suh | E04H 15/48 135/145 |
| 2005/0241688 | A1 * | 11/2005 | Wu | E04H 15/48 135/145 |
| 2007/0012347 | A1 * | 1/2007 | Ochi | E04H 15/50 135/145 |
| 2007/0051398 | A1 * | 3/2007 | Kim | E04H 15/28 135/135 |
| 2007/0062569 | A1 * | 3/2007 | Joo-Tai | E04H 15/28 135/120.3 |
| 2010/0319743 | A1 * | 12/2010 | Zhou | E04H 15/28 135/135 |
| 2015/0376913 | A1 * | 12/2015 | Choi | E04H 15/50 135/147 |
| 2016/0002949 | A1 * | 1/2016 | Yang | E04H 15/46 135/139 |
| 2016/0348392 | A1 * | 12/2016 | Jin | E04H 15/50 |

* cited by examiner

COLLAPSIBLE CANOPY WITH A SELF LOCKING CENTRAL LOCK

The present invention relates to an outdoor product, in particular to a central lock and a collapsible canopy. This application is a Continuation-in-Part (CIP) of U.S. application Ser. No. 15/925,314 filed on Mar. 19, 2018, which is a CIP of U.S. application Ser. No. 15/549,164 filed on Aug. 6, 2017, which is National Stage Entry of PCT Application Serial No. PCT/CN2016/091675, filed on Jul. 26, 2016, all of the above are which are incorporated herein by reference.

BACKGROUND OF THE INVENTION

Collapsible canopies that are capable of being locked into an unfolded position are very popular in modern society. Generally, each collapsible canopy comprises a foldable collapsible canopy frame and a collapsible canopy fabric, the collapsible canopy frame consists of a roof frame and four or more supporting legs, the supporting legs are used for supporting the roof frame and are provided with a locking structure on each supporting leg respectively, the collapsible canopy fabric covers the roof frame and is used for sunshading, rain sheltering or wind sheltering. At present, the locking structure is generally a locking pin, and an unfolded state of the collapsible canopy is locked by way of respectively locking each supporting leg. However, this way has the following defects:

In a process where a collapsible canopy is unfolded or folded, a user needs to perform a locking operation or an unlocking operation on a locking mechanism of each supporting leg one by one when unfolding or folding the collapsible canopy. The operation is cumbersome, functional defects or improper operation of forcing unlocking can occur. Also, the unfolding or folding of the collapsible canopy needs cooperation of many people so that the collapsible canopy can be erected. In addition, in a process where the collapsible canopy is unfolded and is erected, stresses of stress points of a plurality of supporting legs are not uniform, thus it is very difficult to support the collapsible canopy at optimum points and consequently the supporting effect of the collapsible canopy is influenced. Damages to the collapsible canopy mostly occur at the supporting legs of the collapsible canopy, since positions of sliding blocks need to be fixed after the collapsible canopy is unfolded, and holes are formed in the supporting legs at the fixing positions of the sliding blocks for inserting locking pins. Holes in the supporting legs weakens the supporting strength of the supporting legs, and the supporting legs are usually damaged at the fixing positions of the sliding blocks and consequently the service life of the collapsible canopy is shortened.

What is needed is collapsible canopy with a better locking mechanism.

SUMMARY OF THE INVENTION

The present invention provides a collapsible canopy with an improved locking mechanism. The collapsible canopy has at least three supporting legs. The collapsible canopy also has a self-locking central lock that is used for locking the collapsible canopy in an unfolded state and permits the collapsible canopy to be folded into a folded state when the central lock is unlocked. An outer retractable unit is connected between each adjacent supporting leg. An inner retractable unit having an inner end is connected between each supporting leg and the central lock. The inner end of the inner retractable unit is connected through the central lock.

DETAILED DESCRIPTION OF THE PREFERRED EMBODIMENTS

The present invention provides a collapsible canopy that utilizes a self-locking central lock to lock the canopy in an unfolded state for secure usage. The self-locking central lock is highly effective and reliable and is very resistant to corrosion and damage due to exposure and use. The below listed embodiments present collapsible canopies with various self-locking central locks that may be utilized.

Preferred Embodiment with Stop Pole Connected to Center Top Cap

Figure 1:
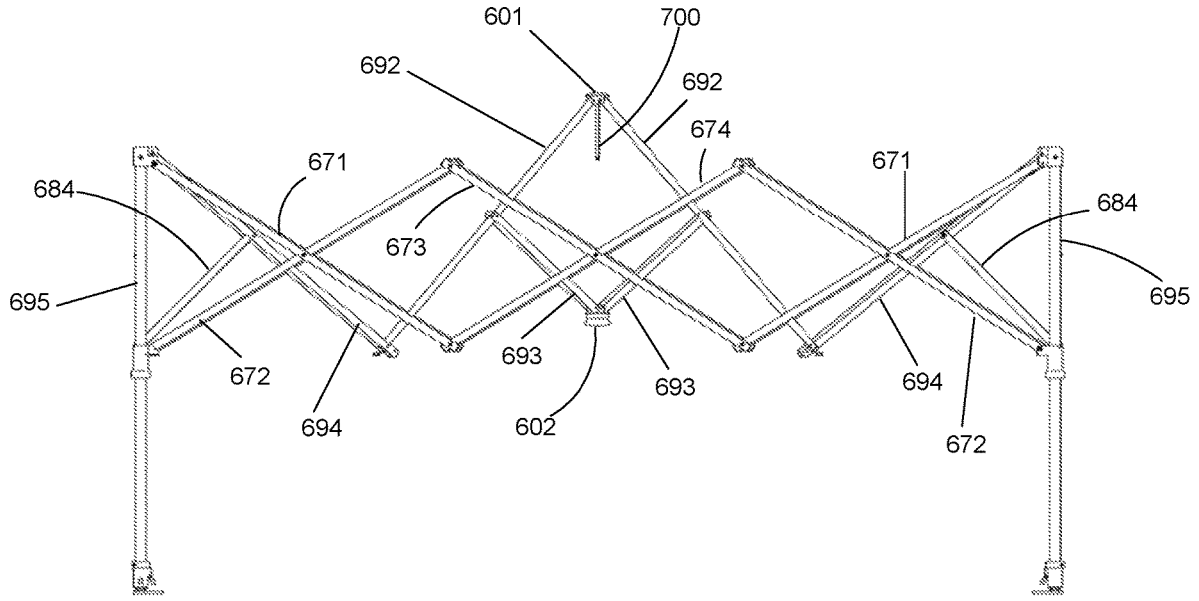
FIGS. 1-9 show a preferred embodiment of the present invention utilizing a stop pole as a stopping device.
Figure 2:
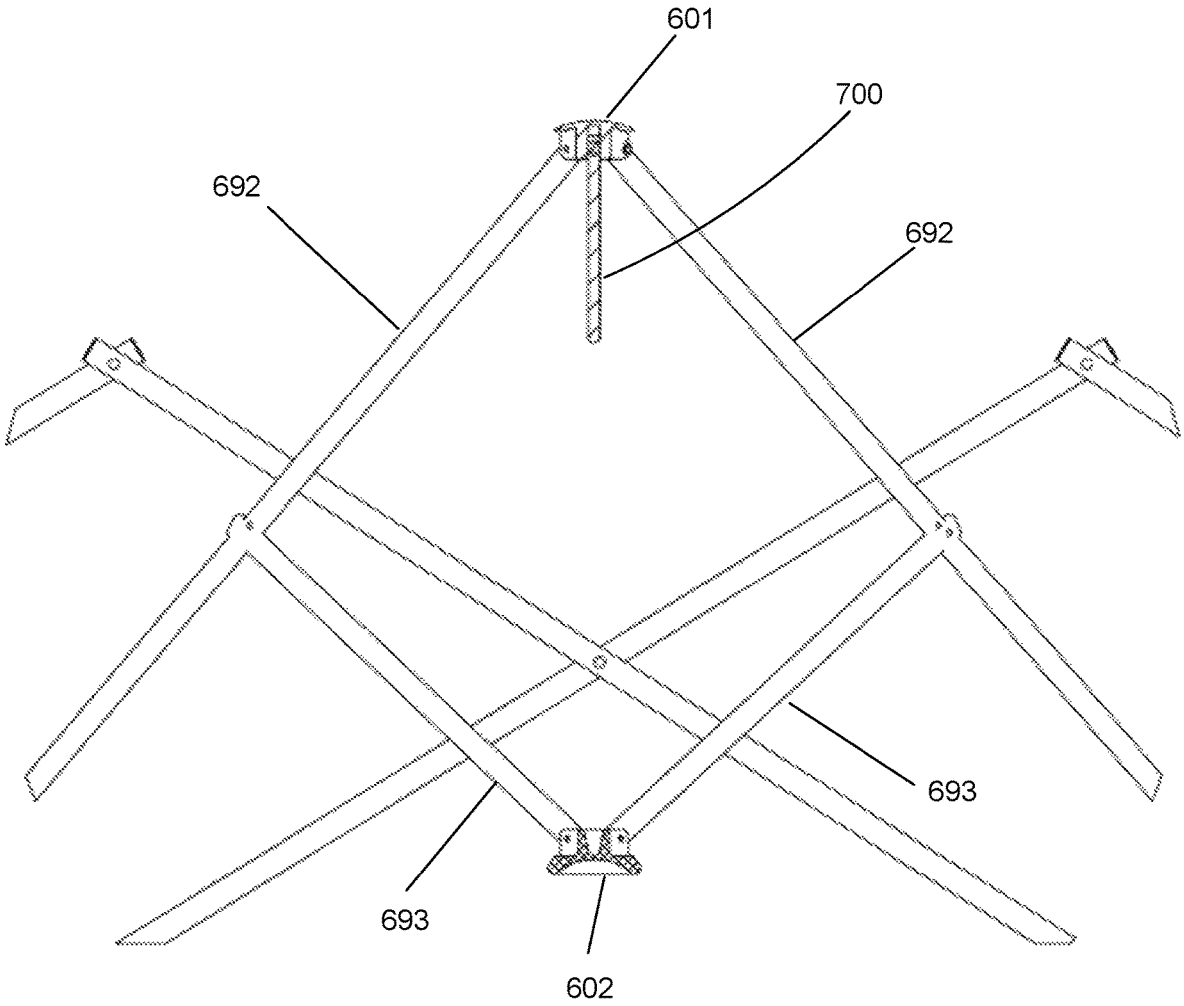

A first preferred embodiment showing collapsible canopy 750 is shown in FIGS. 1-4. In FIG. 1, center top cap 601 is pivotally connected to four first oblique top pipes 692. Center bottom cap 602 is pivotally connected to four bottom cap connecting rods 693. Four second oblique top pipes 694 are each pivotally connected to a first oblique top pipe 692 at one end and are each pivotally connected to a supporting leg 695 at the other end. Leg connecting rods 684 are pivotally connected between support legs 695 and second oblique top pipes 694, as shown. The pivot connection between center top cap 601 and support legs 695 of top pipes 692 and 694 form inner retractable units 615.

First eave pipes 671 and second eave pipes 672 are pivotally connected to supporting legs 695 and are pivotally connected to each other as shown. Middle eave pipes 673 and 674 are pivotally connected between first eave pipes 671 and second eave pipes 672, as shown. Pivotally connected eave pipes 671-674 form outer retractable units 614 that are pivotally connected between support legs 695.

Stop pole 700 is bolted onto center top cap 601 so that it is rigidly attached. Stop pole 700 extends downward from center top cap 601 as shown.

Figure 3:
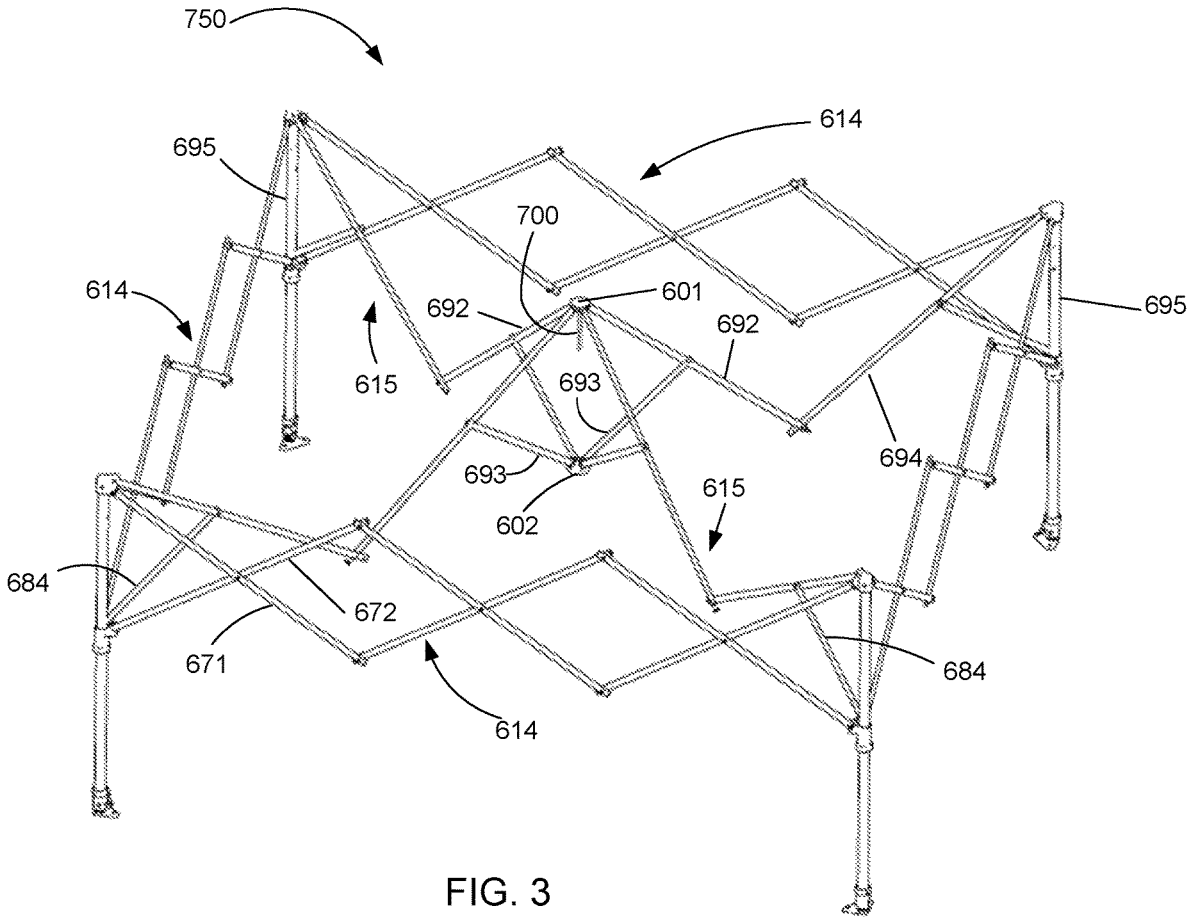
Figure 5:
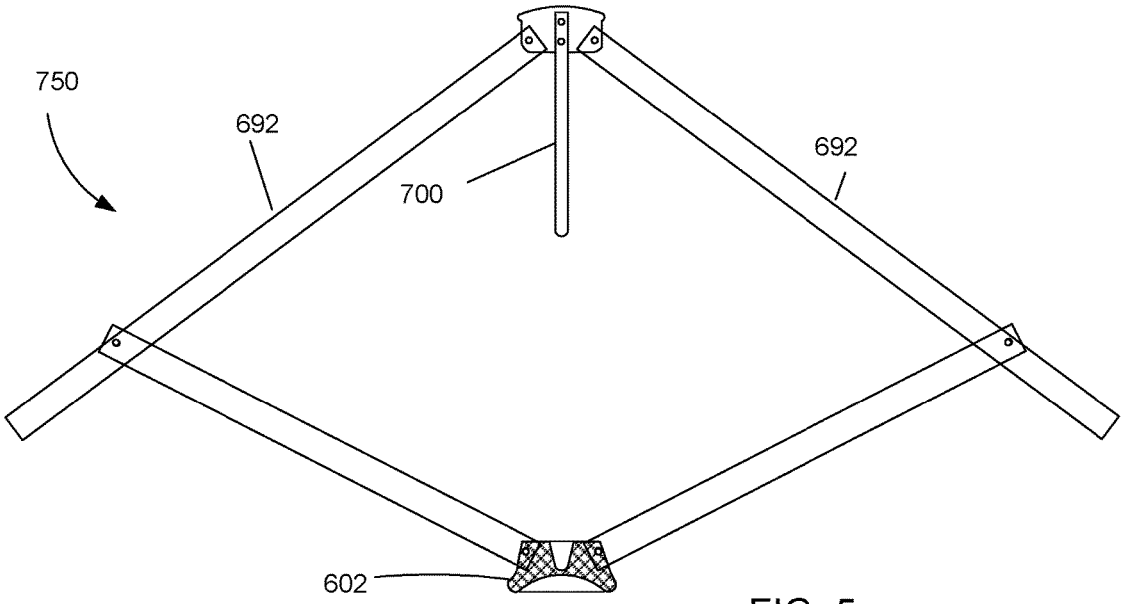

Operation of Preferred Embodiment with Stop Pole Connected to Center Top Cap FIG. 5 shows collapsible canopy 750 in an unlocked and collapsed position, similar to that depicted in FIG. 3. In FIG. 3 the force of gravity is pressing downwards on first oblique top pipes 692. The user has not yet pressed upward on center bottom cap 602.

Figure 6:
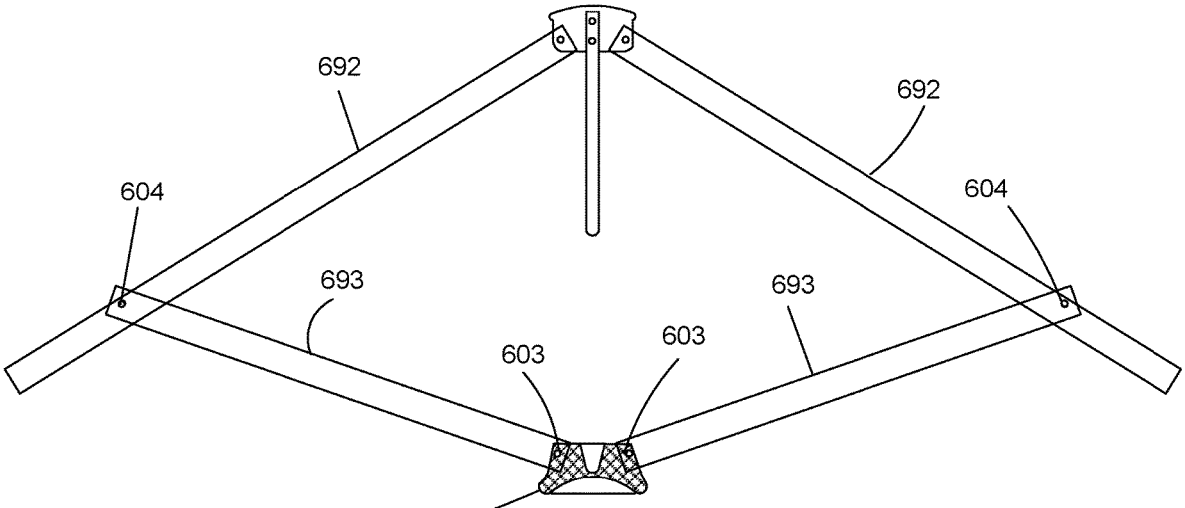

In FIG. 6, the user has begun to press upwards on bottom cap 602. Oblique top pipes 692 have begun to pivot outwards from center. Bottom cap connecting rods 693 are pivotally connected to bottom cap 602 at bottom cap pivot axis 603 and bottom cap connecting rods 693 are pivotally connected to oblique top pipes 692 at top pipe pivot axis 604. In FIG. 6, pivot axis 603 is lower than pivot axis 604. Therefore, the user must continue to press upward on bottom cap 602 to overcome the weight of oblique top pipes 692.

Figure 7:
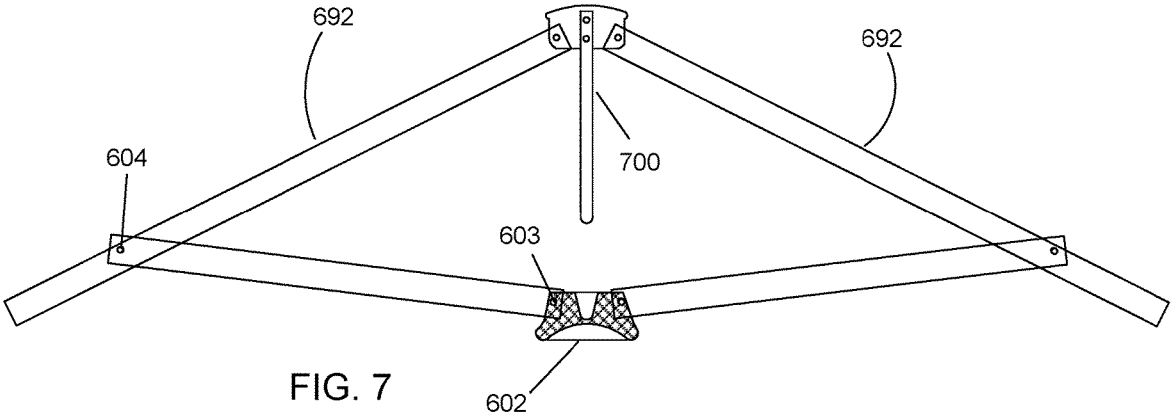

In FIG. 7, the user has pressed further upwards on bottom cap 602. Oblique top pipes 692 have pivoted further outwards. In FIG. 7, pivot axis 603 is still lower than pivot axis 604. Therefore, the user must still continue to press upward on bottom cap 602 to overcome the weight of oblique top pipes 692.

Figure 8:
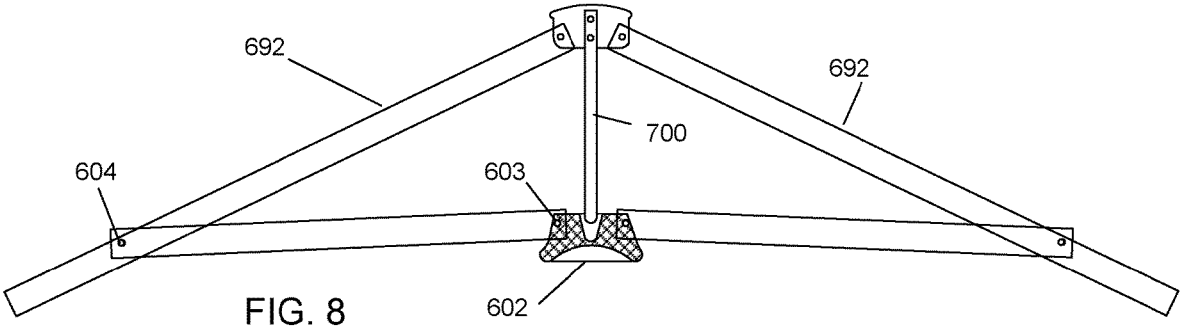

In FIG. 8, the user has pressed further upwards on bottom cap 602. Pivot axis 603 is now higher than pivot axis 604. Once the pivot axis 603 becomes higher than pivot axis 604, the weight of oblique top pipes 692 will cause bottom cap 602 to move upward so that the user no longer has to press upward on bottom cap 602. In FIG. 8, top pipes 692 have begun to pivot inwards and bottom cap 602 is being forced upwards towards stop pole 700. The user may now stop upwards pressure on bottom cap 602. The downward force provided by oblique top pipes 692 will move bottom cap 602 upwards until is stopped by stop pole 700.

Figure 4:
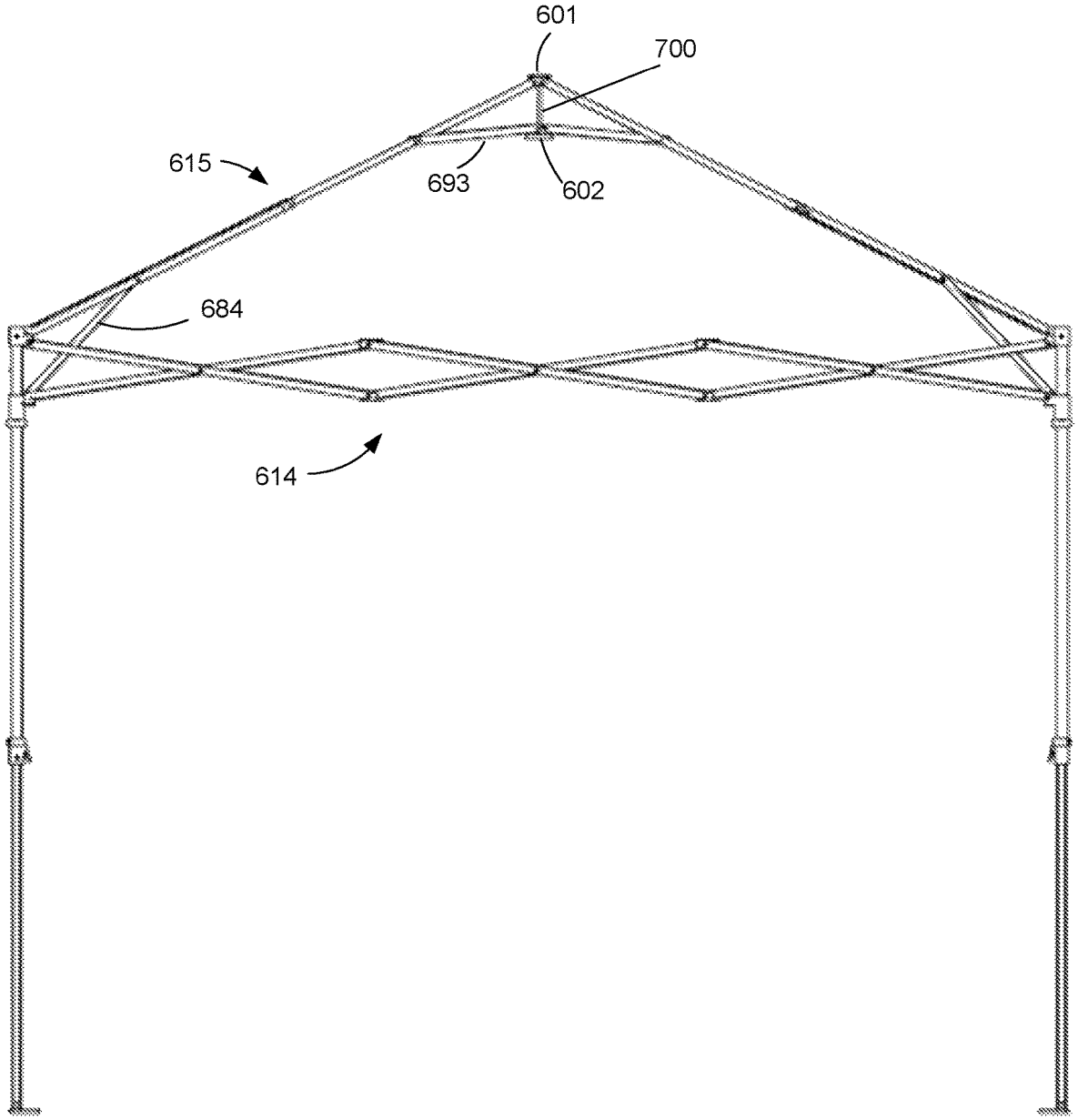
Figure 9:
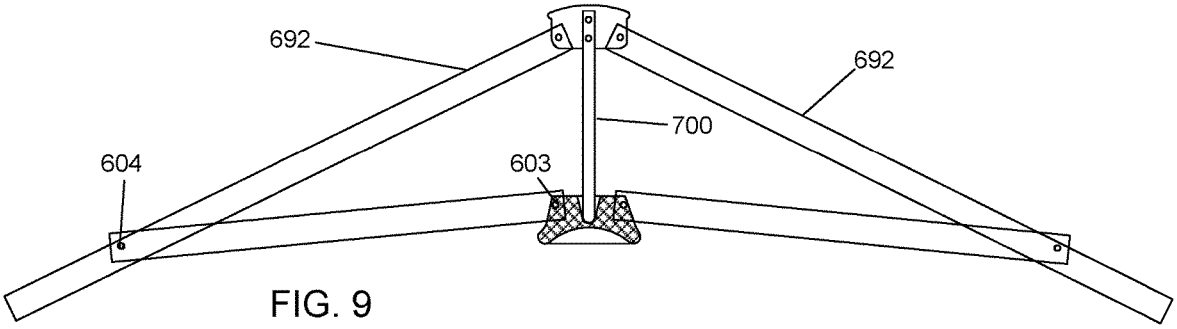

In FIG. 9, the downward force provided by oblique top pipes 692 has moved bottom cap 602 upwards so that it has been stopped by stop pole 700. Pivot axis 603 is higher than pivot axis 604. Center locking mechanism 720 is now in a self-locked position. It should be noted that a self-locked position is achieved after bottom cap pivot axis 603 becomes higher than top pipe pivot axis 604. After that occurs, the user may cease applying upward force onto bottom cap 602. The force of gravity acting on top pipes 692 will force bottom cap 602 upwards until it is stopped by a stopping device, such as stopping pole 700. Once the upward motion has been stopped collapsible canopy 750 will be in a secure, locked position, as shown in FIGS. 4 and 9.

To unlock collapsible canopy 750 the user will need to pull downward on bottom cap 602 until pivot axis 603 is lower than pivot axis 604. Once this occurs, the force of gravity will take over and collapsible canopy 750 will be in the unlocked position as shown in FIGS. 1 and 3.

Preferred Embodiment with Center Top Cap as the Stopping Device

Figure 10:
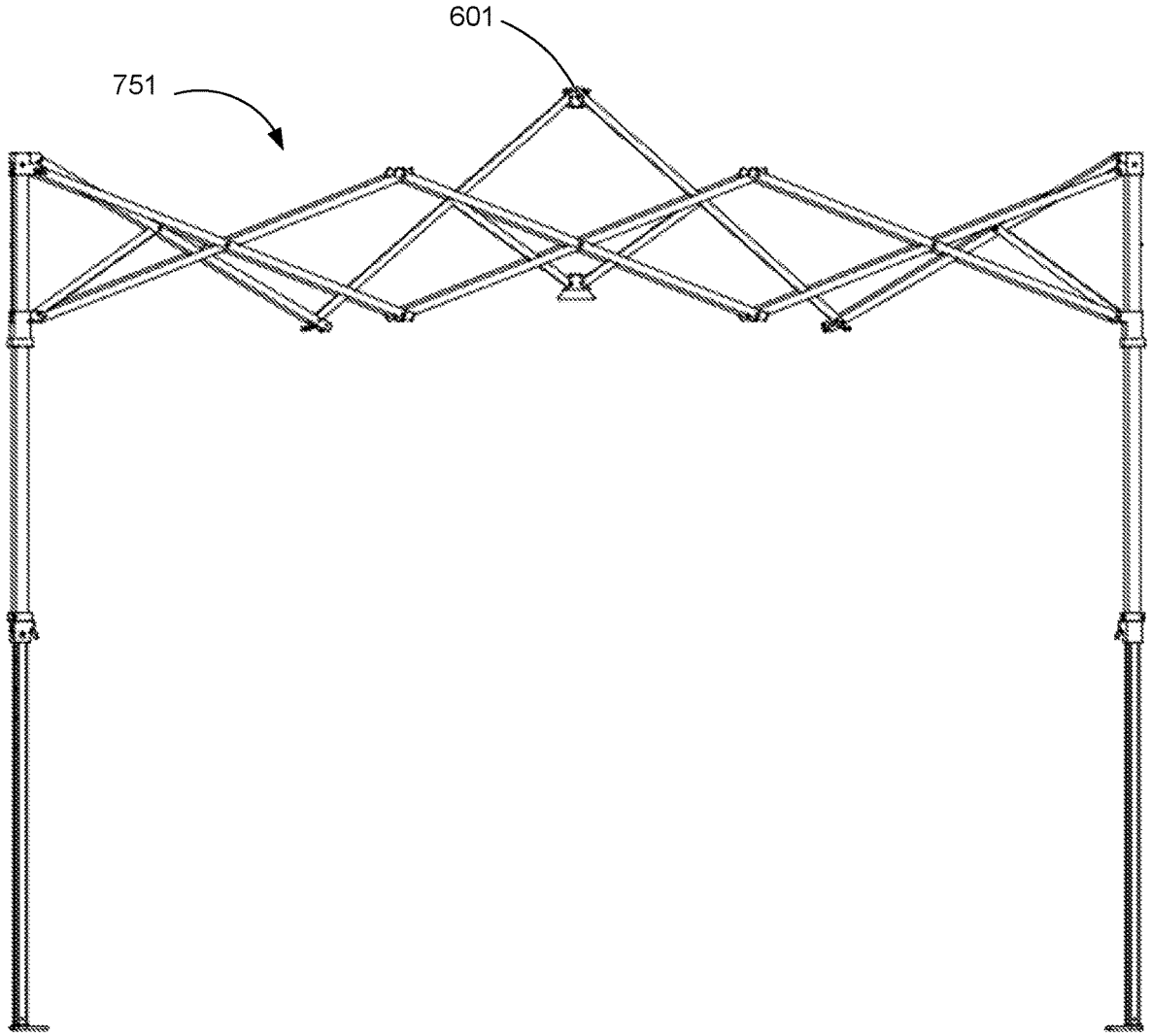
FIGS. 10-16 show another preferred embodiment of the present invention utilizing the central top cap as the stopping device.
Figure 11:
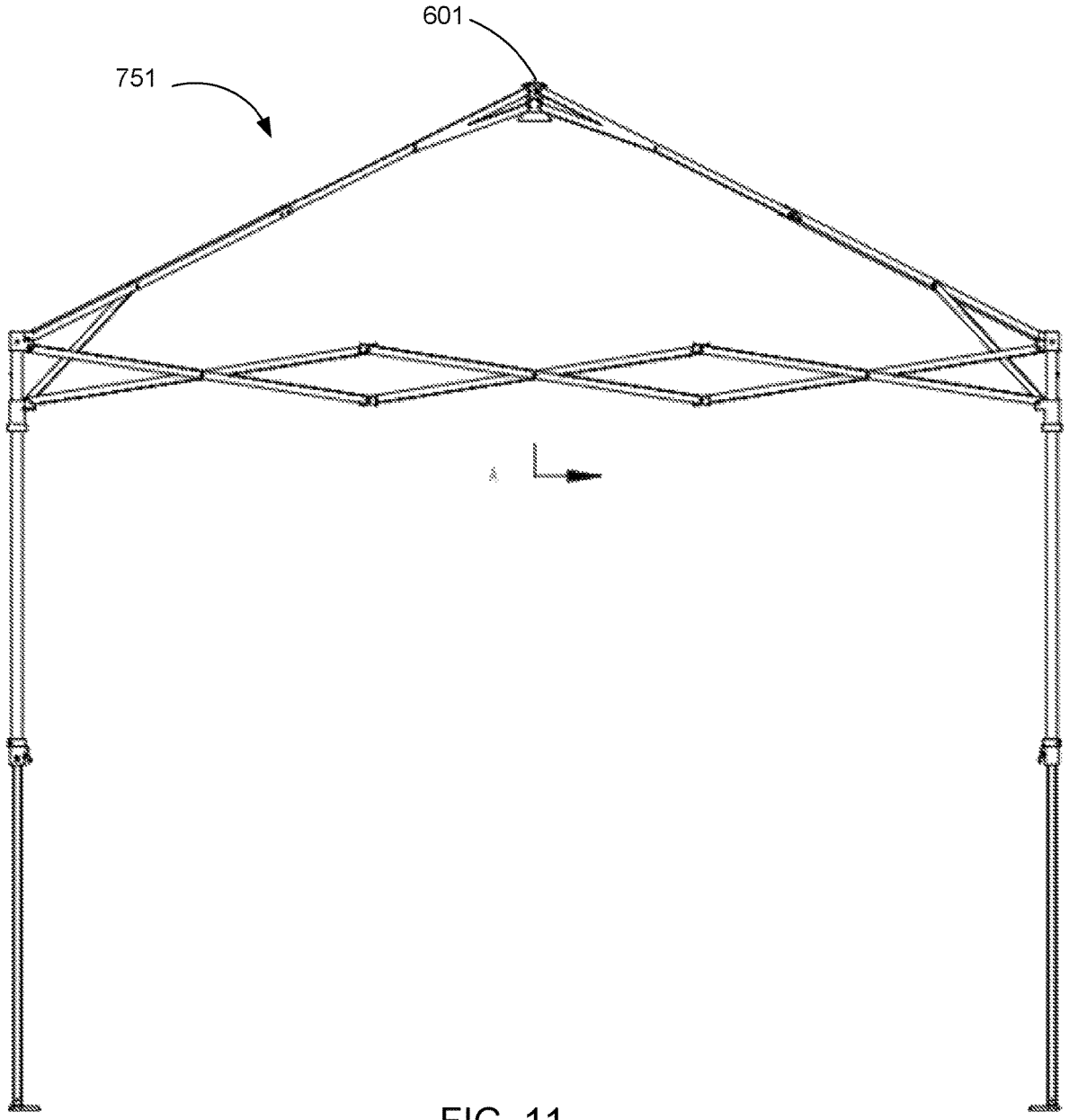

Another preferred embodiment showing collapsible canopy 751 is shown in FIGS. 10-11. Collapsible canopy 751 is very similar to collapsible canopy 750 described above. However, rather than utilizing stop pole 700, collapsible canopy 751 utilizes center top cap 601 as the stopping device. This embodiment is preferred due to its simplicity and its cost effectiveness.

Figure 12:
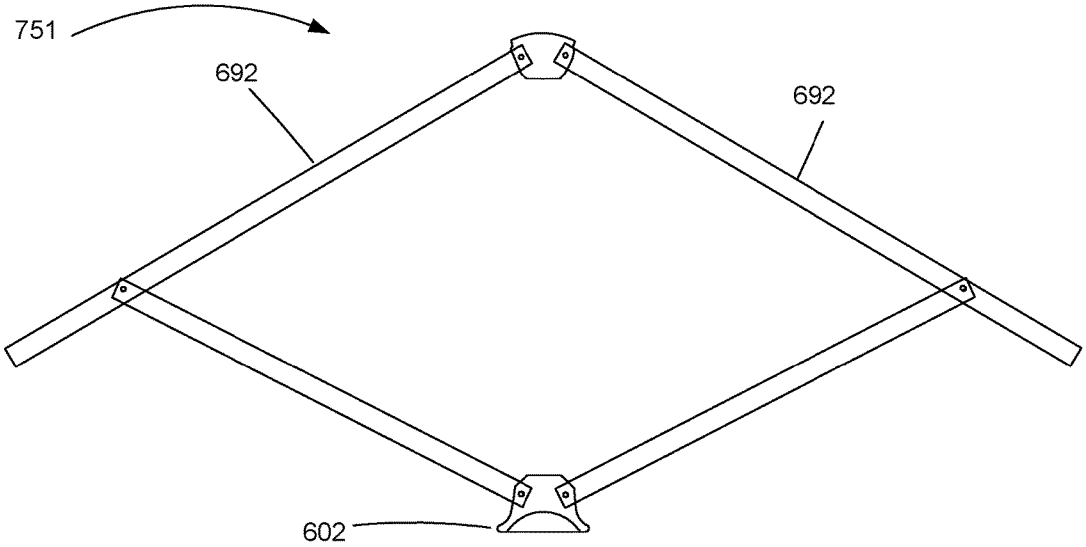

Operation of Preferred Embodiment Utilizing the Center Top Cap as the Stopping Device FIG. 12 shows collapsible canopy 751 in an unlocked and collapsed position, similar to that depicted in FIG. 12. In FIG. 12 the force of gravity is pressing downwards on first oblique top pipes 692. The user has not yet pressed upward on center bottom cap 602.

Figure 13:
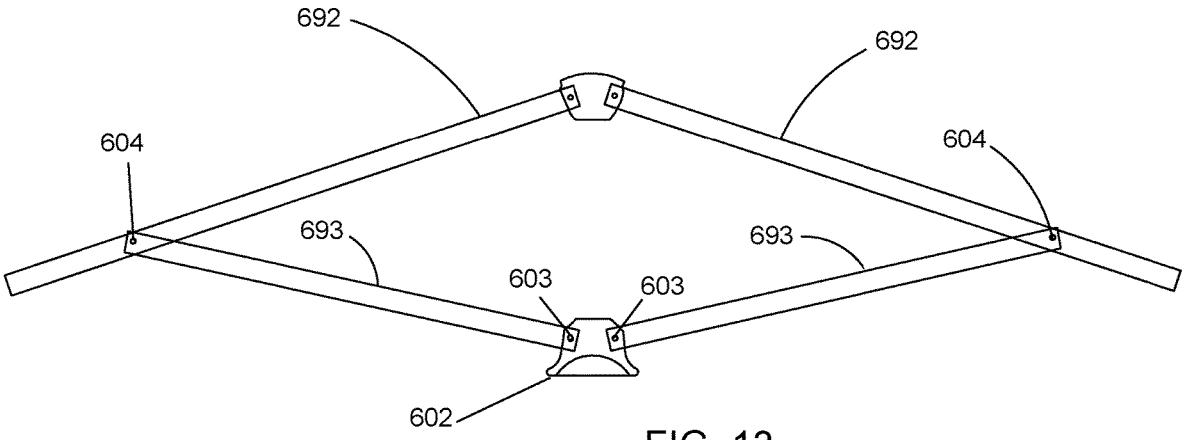

In FIG. 13, the user has begun to press upwards on bottom cap 602. Oblique top pipes 692 have begun to pivot outwards from center. Bottom cap connecting rods 693 are pivotally connected to bottom cap 602 at bottom cap pivot axis 603 and bottom cap connecting rods 693 are pivotally connected to oblique top pipes 692 at top pipe pivot axis 604. In FIG. 13 pivot axis 603 is lower than pivot axis 604. Therefore, the user must continue to press upward on bottom cap 602 to overcome the weight of oblique top pipes 692.

Figure 14:
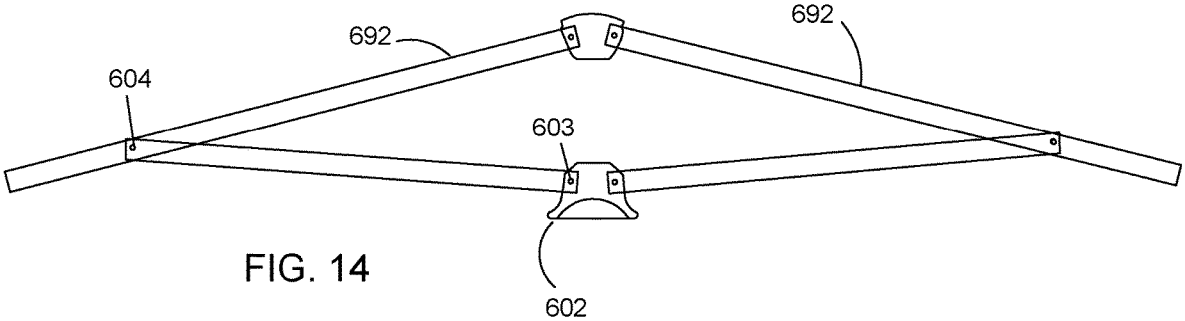

In FIG. 14, the user has pressed further upwards on bottom cap 602. Oblique top pipes 692 have pivoted further outwards. In FIG. 14, pivot axis 603 is still lower than pivot axis 604. Therefore, the user must still continue to press upward on bottom cap 602 to overcome the weight of oblique top pipes 692.

Figure 15:
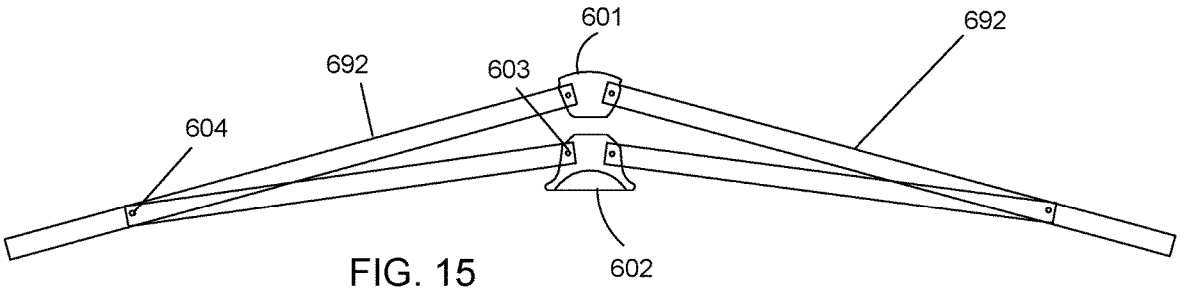

In FIG. 15, the user has pressed further upwards on bottom cap 602. Pivot axis 603 is now higher than pivot axis 604. Once the pivot axis 603 becomes higher than pivot axis 604, the weight of oblique pipes 692 will cause bottom cap 602 to move upward so that the user no longer has to press upward on bottom cap 602. In FIG. 15, top pipes 692 have begun to pivot inwards and bottom cap 602 is being forced upwards towards center top cap 601. The user may now stop upwards pressure on bottom cap 602. The downward force provided by oblique top pipes 692 will move bottom cap 602 upwards until is stopped by center top cap 601.

Figure 16:
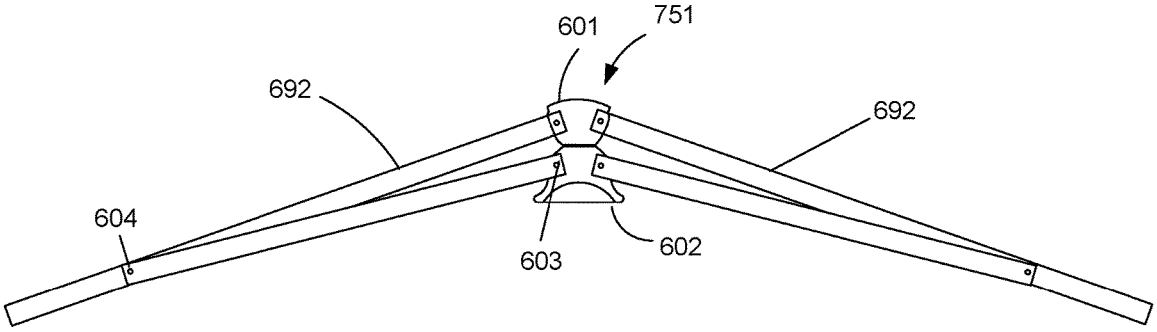

In FIG. 16, the downward force provided by oblique top pipes 692 has moved bottom cap 602 upwards so that it has been stopped by center top cap 601. Pivot axis 603 is higher than pivot axis 604. Center locking mechanism 721 is now in a self-locked position. It should be noted that a self-locked position is achieved after bottom cap pivot axis 603 becomes higher than top pipe pivot axis 604. After that occurs, the user may stop applying upward force onto bottom cap 602. The force of gravity acting on top pipes 692 will force bottom cap 602 upwards until it is stopped by a stopping device, such as center top cap 601. Once the upward motion has been stopped collapsible canopy 751 will be in a secure, locked position, as shown in FIGS. 16 and 11.

To unlock collapsible canopy 751 the user will need to pull downward on bottom cap 602 until pivot axis 603 is lower than pivot axis 604. Once this occurs, the force of gravity will take over and collapsible canopy 750 will be in the unlocked position as shown in FIGS. 36 and 38.

Figure 17:
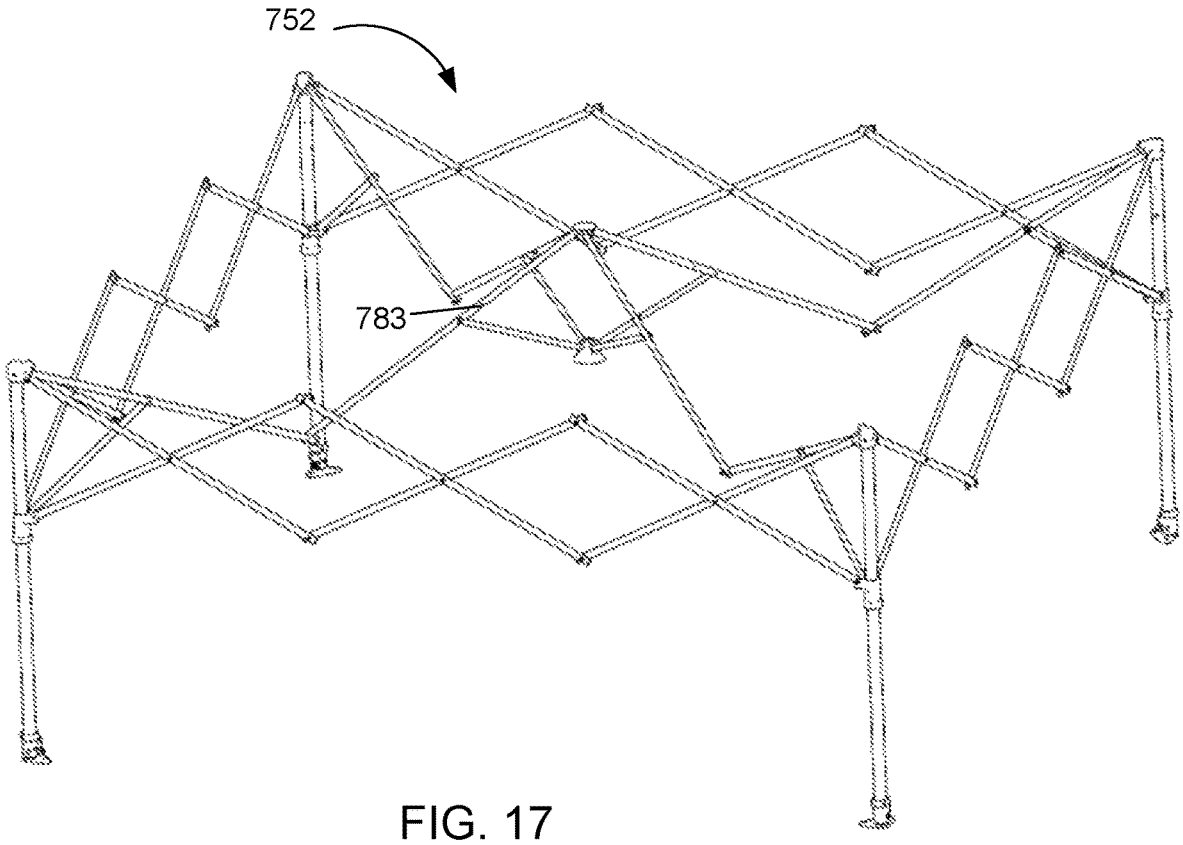
FIGS. 17-23 show another preferred embodiment of the present invention utilizing stopping plugs connected to top pipes as the stopping device.
Figure 18:
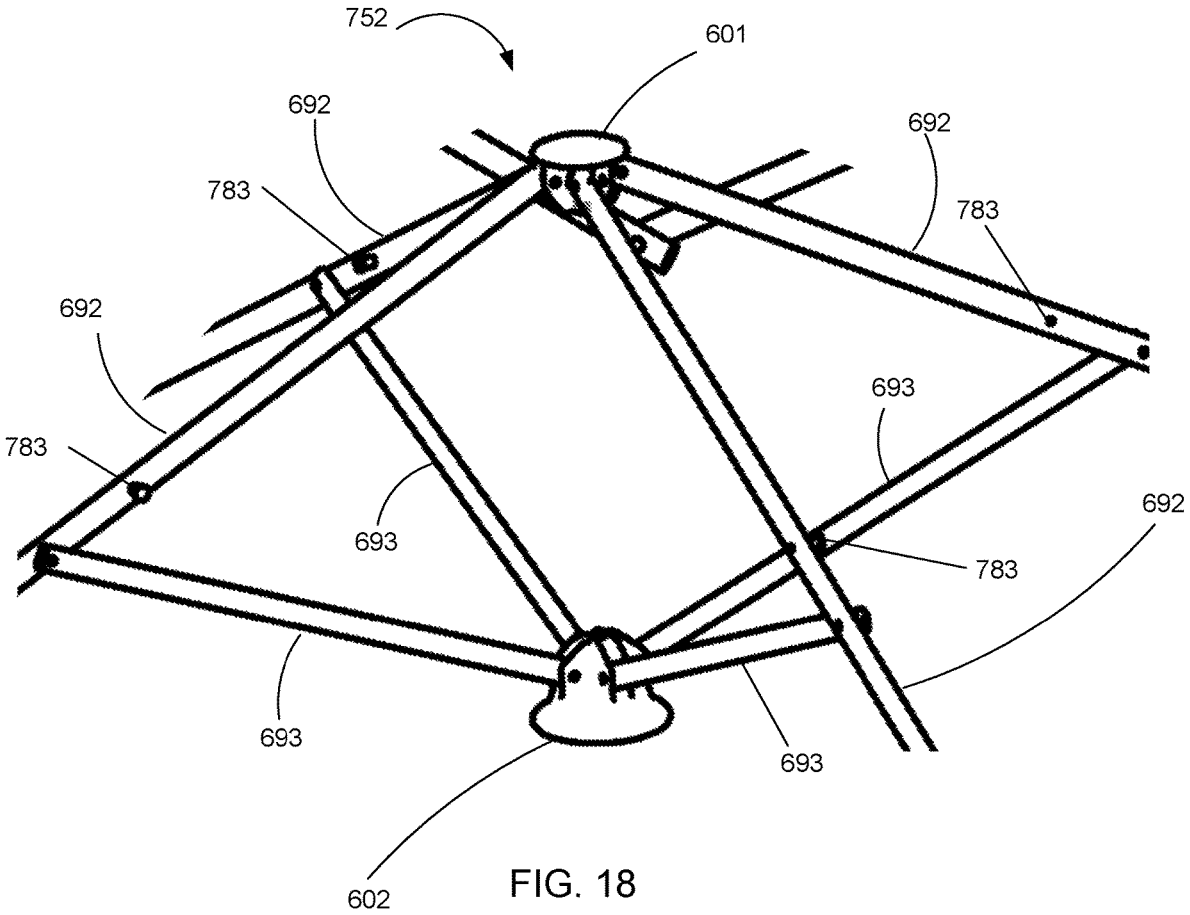
Figure 19:
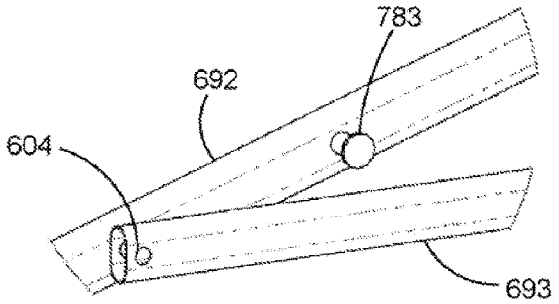

Preferred Embodiment with Plugs Mounted to the Top Pipes as the Stopping Device Another preferred embodiment showing collapsible canopy 752 is shown in FIGS. 17-18. Collapsible canopy 752 is very similar to collapsible canopies 751 and 752 described above. However, collapsible canopy 752 utilizes plugs 783 mounted to top pipes 692 as the stopping device. FIG. 19 shows a detailed view of plug 783 mounted to top pipe 692 over connecting rod 693 pivotally connected at pivot axis 604. This embodiment shows that a stopping device may be mounted to a top pipe.

Figure 20:
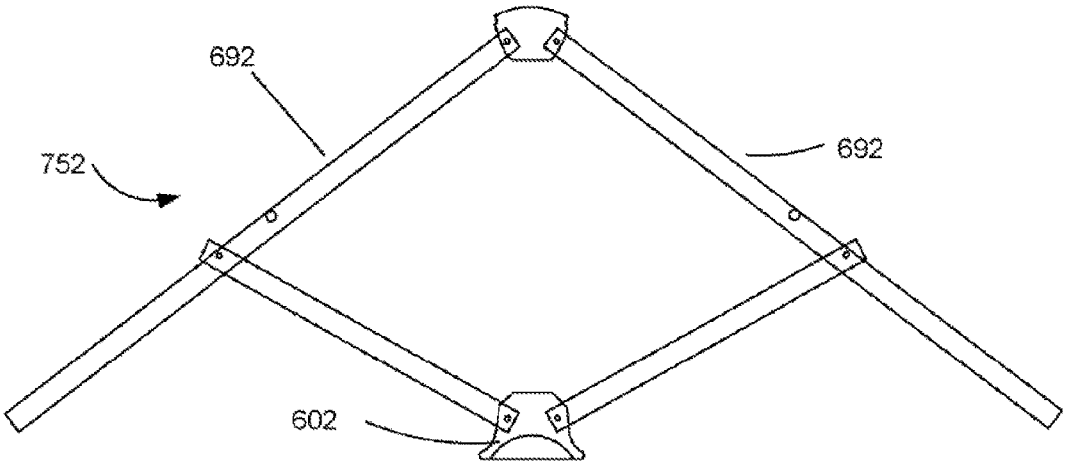

Operation of Preferred Embodiment Utilizing Top Pipe Mounted Plugs as the Stopping Device FIG. 20 shows collapsible canopy 752 in an unlocked and collapsed position, similar to that depicted in FIG. 17. In FIG. 20 the force of gravity is pressing downwards on first oblique top pipes 692. The user has not yet pressed upward on center bottom cap 602.

Figure 21:
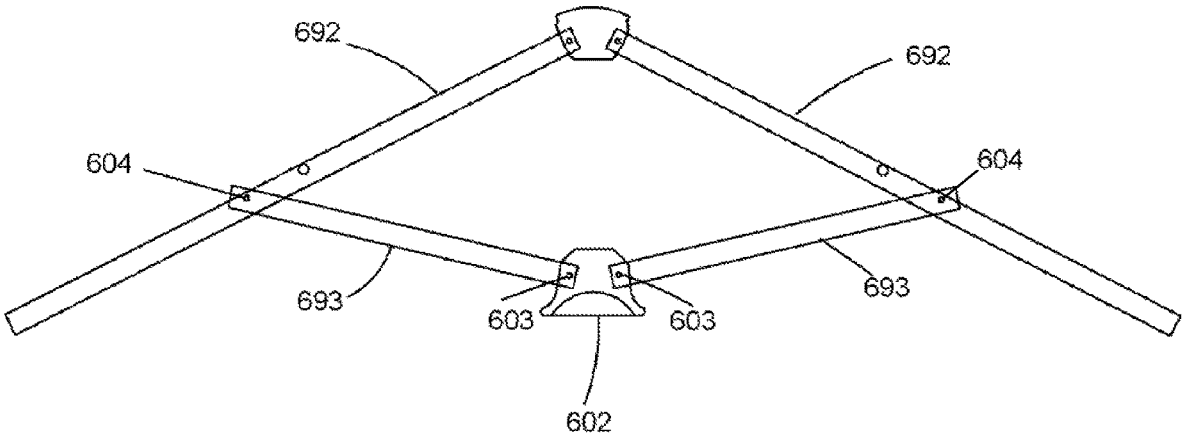

In FIG. 21, the user has begun to press upwards on bottom cap 602. Oblique top pipes 692 have begun to pivot outwards from center. Bottom cap connecting rods 693 are pivotally connected to bottom cap 602 at bottom cap pivot axis 603 and bottom cap connecting rods 693 are pivotally connected to oblique top pipes 692 at top pipe pivot axis 604. In FIG. 21, pivot axis 603 is lower than pivot axis 604.

Therefore, the user must continue to press upward on bottom cap 602 to overcome the weight of oblique top pipes 692.

Figure 22:
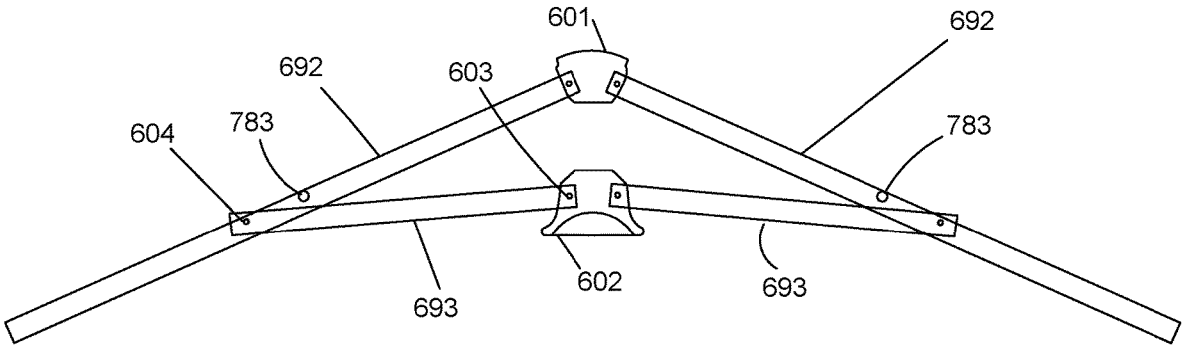

In FIG. 22, the user has pressed further upwards on bottom cap 602. Pivot axis 603 is now higher than pivot axis 604. Once the pivot axis 603 becomes higher than pivot axis 604, the weight of oblique pipes 692 will cause bottom cap 602 to move upward so that the user no longer has to press upward on bottom cap 602. In FIG. 22, top pipes 692 have begun to pivot inwards and bottom cap 602 is being forced upwards towards center top cap 601. The user may now stop upwards pressure on bottom cap 602. The downward force provided by oblique top pipes 692 will move bottom cap 602 upwards until connecting rods 693 are stopped by plugs 783.

Figure 23:
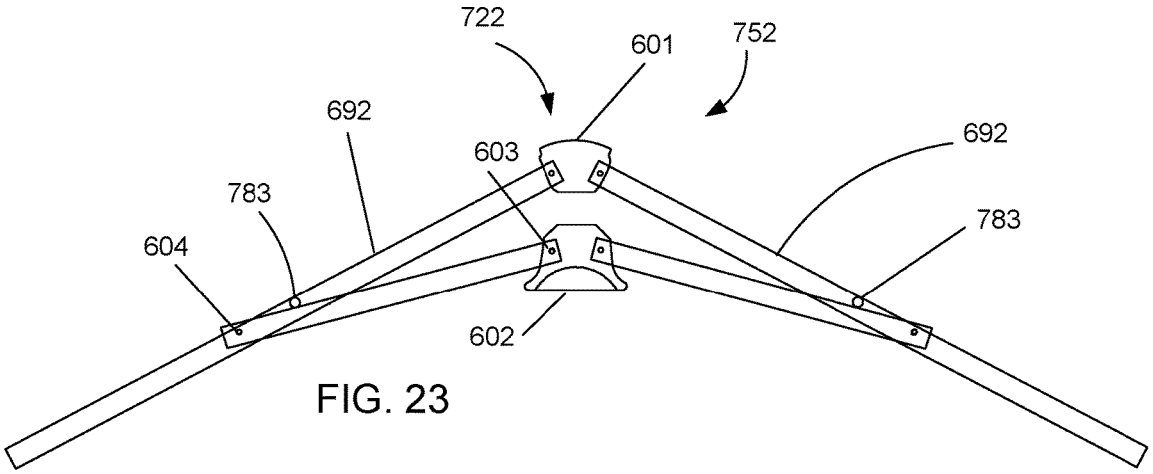

In FIG. 23, the downward force provided by oblique top pipes 692 has moved bottom cap 602 upwards so that the upward motion of connecting rods 693 has been stopped by plugs 783. Pivot axis 603 is higher than pivot axis 604. Center locking mechanism 722 is now in a self-locked position. It should be noted that a self-locked position is achieved after bottom cap pivot axis 603 becomes higher than top pipe pivot axis 604. After that occurs, the user may stop applying upward force onto bottom cap 602. The force of gravity acting on top pipes 692 will force bottom cap 602 upwards until connecting rods 693 are stopped by a stopping device, such as plugs 783. Once the upward motion has been stopped collapsible canopy 752 will be in a secure, locked position, as shown in FIG. 23.

To unlock collapsible canopy 752 the user will need to pull downward on bottom cap 602 until pivot axis 603 is lower than pivot axis 604. Once this occurs, the force of gravity will take over and collapsible canopy 752 will be in the unlocked position as shown in FIGS. 17 and 18.

Figure 24:
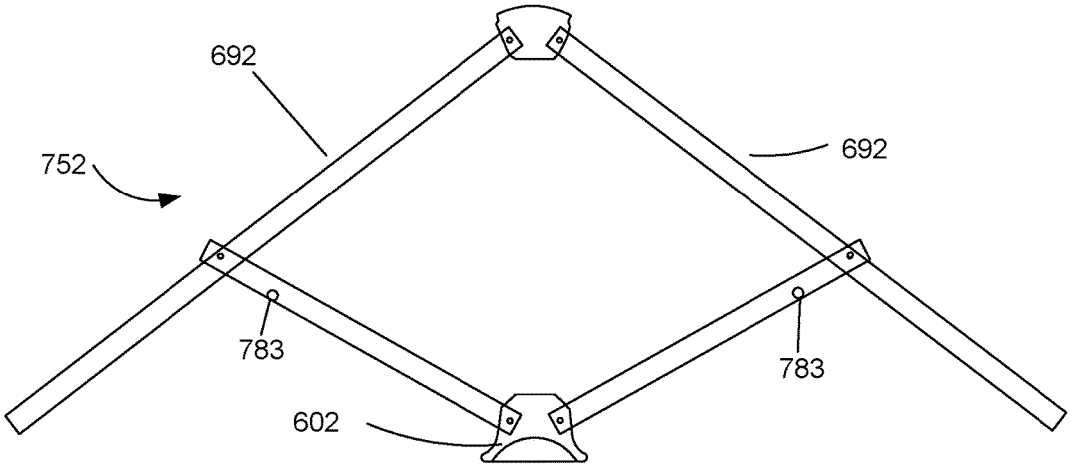
FIGS. 24-25 show another preferred embodiment of the present invention utilizing stopping plugs connected to connecting rods as the stopping device.
Figure 25:
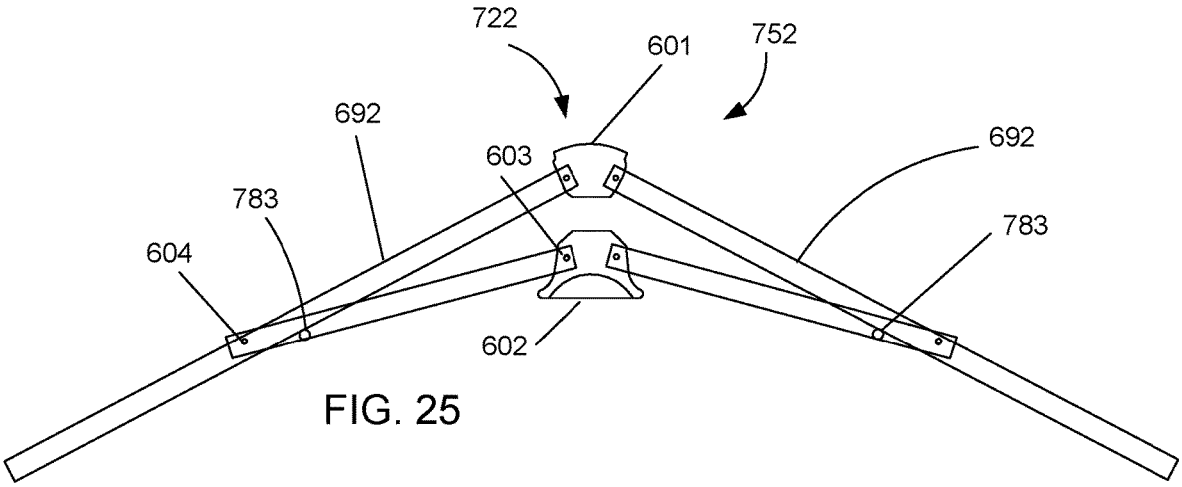

Preferred Embodiment with Plugs Mounted to Connecting Rods as the Stopping Device FIGS. 24 and 25 show plugs 783 mounted to connecting rods 693. This embodiment is similar to the previous embodiment with the exception that plugs 783 are mounted to connecting rods 693 rather than top pipes 692.

For example, in FIG. 25, the downward force provided by oblique top pipes 692 has moved bottom cap 602 upwards so that the upward motion of connecting rods 693 has been stopped by plugs 783 coming in contact with top pipes 692. Pivot axis 603 is higher than pivot axis 604. Center locking mechanism 722 is now in a self-locked position. It should be noted that a self-locked position is achieved after bottom cap pivot axis 603 becomes higher than top pipe pivot axis 604. After that occurs, the user may stop applying upward force onto bottom cap 602. The force of gravity acting on top pipes 692 will force bottom cap 602 upwards until the upward motion of connecting rods 693 is stopped by a stopping device, such as plugs 783 coming into contact with top pipes 692. Once the upward motion has been stopped collapsible canopy 752 will be in a secure, locked position, as shown in FIG. 25.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A collapsible canopy, comprising:

A. at least three supporting legs,

B. a plurality of outer retractable units, each outer retractable unit connected between two of said at least three supporting legs, C. a plurality of inner retractable units comprising inner ends, each inner retractable unit connected to one of said at least three supporting legs, wherein said outer retractable units and said inner retractable units form a roof frame of said collapsible canopy, and D. a self-locking central lock for locking said collapsible canopy in an unfolded state when said central lock is locked and for permitting said collapsible canopy to be folded into a folded state when said central lock is unlocked, wherein said inner ends of said inner retractable units are connected to said central lock, wherein self-locking central lock comprises:

i. a center top cap, ii. a center bottom cap, iii. a stopping device wherein said self-locking central lock is put into a locking position when said center bottom cap is moved towards said center top cap and wherein said movement is stopped by contact with said stopping device, wherein only said contact with said stopping device is necessary to hold said self-locking central lock in said locking position and no other locking mechanism is necessary to maintain said self-locking central lock in said locking position.

2. The collapsible canopy as in claim 1, wherein said self-locking central lock comprises:

C. at least two top pipes pivotally connected to said central top cap, and

D. at least two connecting rods, each one pivotally connected at a top pipe pivot axis to one of said at least two top pipes, and each one pivotally connected to said bottom cap at a bottom cap pivot axis, wherein said self-locking central lock is placed in a locked position by upward movement of said bottom cap and said at least two connecting rods, wherein as said bottom cap is pushed upward said self-locking central lock moves to said locking position when:

i. said bottom cap pivot axis is pressed higher than said top pipe pivot axis, and ii. said upward movement of said bottom cap and said at least two connecting rods is stopped by said stopping device.

3. The collapsible canopy as in claim 2, wherein said stopping device is at least one stopping plug rigidly connected to at least one of said at least two top pipes.

4. The collapsible canopy as in claim 2, wherein said stopping device is at least one stopping plug rigidly connected to at least one of said at least two connecting rods.

5. The collapsible canopy as in claim 2, wherein said at least two top pipes are four top pipes and wherein said at least two connecting rods are four connecting rods.

* * * * *